US007430278B2

(12) United States Patent
Sundaram et al.

(10) Patent No.: US 7,430,278 B2
(45) Date of Patent: Sep. 30, 2008

(54) INSULATION METHODS AND ARRANGEMENTS FOR AN X-RAY GENERATOR

(75) Inventors: Senthil Kumar Sundaram, Navi Mumbai (IN); Rohini Krishnamoorthy, Bangalore (IN)

(73) Assignee: General Electric Company, Schenectady, NY (US)

( * ) Notice: Subject to any disclaimer, the term of this patent is extended or adjusted under 35 U.S.C. 154(b) by 5 days.

(21) Appl. No.: 10/888,892

(22) Filed: Jul. 9, 2004

(65) Prior Publication Data

US 2006/0008055 A1 Jan. 12, 2006

(51) Int. Cl.
*H01J 35/02* (2006.01)

(52) U.S. Cl. ..... 378/139

(58) Field of Classification Search ..... 378/139
See application file for complete search history.

(56) References Cited

U.S. PATENT DOCUMENTS 984,726 A * 2/1911 Winter et al. ..... 378/139
1,567,012 A * 12/1925 Pilon ..... 378/91
2,094,103 A * 9/1937 Horsley et al. ..... 378/160
2,145,727 A * 1/1939 Lloyd, Jr. ..... 378/103
2,256,229 A * 9/1941 Atlee et al. ..... 378/139
2,516,663 A * 7/1950 Zunick ..... 378/139
3,714,486 A * 1/1973 McCrary ..... 378/143
4,247,782 A * 1/1981 Muraki ..... 378/139
4,572,982 A 2/1986 Farrall
6,320,936 B1 * 11/2001 Holland et al. ..... 378/140
6,456,692 B1 * 9/2002 Smith ..... 378/129
6,644,853 B1 * 11/2003 Kantor et al. ..... 378/203
7,145,988 B2 * 12/2006 Price et al. ..... 378/136
2001/0048967 A1 12/2001 Wilson et al.

FOREIGN PATENT DOCUMENTS

JP 55003140 A * 1/1980

* cited by examiner

*Primary Examiner*—Chih-Cheng G Kao
(74) *Attorney, Agent, or Firm*—Armstrong Teasdale LLP

(57) ABSTRACT

Methods and arrangements for providing insulation in an X-ray generator are provided. The method includes providing an insulation member having a conductive element electrically coupled to a component within an X-ray system. The insulation member is located at a distance from the component with a thermal transfer fluid between the conductive element and the component. The method further includes configuring the conductive element to have an electric potential substantially equal to an electric potential of the component wherein the electric field within the thermal transfer fluid is reduced.

21 Claims, 8 Drawing Sheets

INSULATION METHODS AND ARRANGEMENTS FOR AN X-RAY GENERATOR

BACKGROUND OF THE INVENTION

This invention relates generally to insulation methods and arrangements, and more particularly, to methods and arrangements for electrical and thermal stress management in an X-ray generator.

An X-ray generator (e.g., X-ray tube head) having a generator and an X-ray tube within a housing provides a compact source for X-ray generation in diagnostic medical imaging, industrial inspection systems, security scanners, etc. For high power X-ray generation, the X-ray generator may be operated at very high voltage, for example, more than 70 kV and at temperatures exceeding 200 degrees Celsius (C.) at the anode of the X-ray tube in an X-ray generator. Such operation may cause high stress zones having thermal and electrical stresses at the insulating material around the anode.

Known X-ray generators use insulating oil as a medium to provide insulation and also acts as a coolant to dissipate heat around the anode. However, the insulating oil may experience electro-hydrodynamic (EHD) forces resulting in strong electro-convection due to very high electrical stress, for example, around an anode. This may provide heat dissipation, but increases the likelihood of insulation breakdown. Moreover, oil insulation generally posses high sensitivity to particulate contamination and moisture that also may cause insulation breakdown. Furthermore, at the zone around the anode, X-ray photons may ionize the oil, thereby resulting in breakdown of oil at lower voltage levels.

Solid insulation also is known and provided as an insulating material to have high insulating strength. However, solid insulation typically has poor thermal properties compared to oil insulation.

Composite insulation configurations using solid insulation as a barrier in oil are often used to improve insulation strength. Although the composite insulation configuration improves insulation, it may not provide adequate heat dissipation.

Further, in X-ray applications, the geometry of the X-ray tube, particularly around the anode, which is at positive high voltage, and the surrounding casing at ground potential, often results in non-uniform electrical as well as thermal stress distribution. Non-uniform stress distribution results in a small volume of the medium experiencing very high stress and the rest of the volume experiencing much lower stresses. The electrical and thermal stresses are typically highest around the anode of an X-ray tube and reduces with increasing radial distance from the anode. Therefore, the material or oil around the anode is subjected to very high thermal and electrical stresses.

It is also known to provide a large clearance for insulation and cooling in an attempt to reduce high electrical and thermal stresses. However, this results in a much less compact system for high power applications.

Thus, these known insulation methods have limitations in use of insulation materials to efficiently manage electrical and thermal stresses around the anode of an X-ray tube and also fail to provide compact arrangement with a high degree of reliability for X-ray generators in continuous high power applications.

BRIEF DESCRIPTION OF THE INVENTION

In one embodiment, an insulation method for an X-ray generator is provided. The method includes providing an insulation member having a conductive element electrically coupled to a component within an X-ray generator. The insulation member is located at a distance from the component with a thermal transfer fluid between the conductive element and the component. The method further includes configuring the conductive element to have an electric potential substantially equal to an electric potential of the component wherein the electric field within the thermal transfer fluid is reduced.

In another embodiment, an insulation arrangement for an X-ray generator is provided. The arrangement includes an insulation member having a conductive element electrically coupled to a component within an X-ray generator. The insulation member is located at a distance from the component with a thermal transfer fluid between the conductive element and the component. The conductive element has an electric potential substantially equal to an electric potential of the component wherein the electric field within the thermal transfer fluid is reduced.

In yet another embodiment, an X-ray generator is provided. The X-ray generator includes a housing, an insulation member disposed on an inside surface of the housing and separated from an anode by a gap and a thermal transfer fluid within the gap. The X-ray generator further includes a conductive surface or combination with the insulation member and configured to provide an electric potential substantially equal to an electric potential of the anode to create an equipotential region in the gap.

DETAILED DESCRIPTION OF THE INVENTION

Various embodiments of the present invention provide insulation methods and arrangements for an X-ray generator. The embodiments, however, are not so limited, and may be implemented in connection with other systems, such as, for example, diagnostic medical imaging systems, industrial inspection systems, security scanners, particle accelerators, etc.

In the various embodiments, to effectively manage electrical and thermal stresses generated due to high voltage and high power operation, the stresses are decoupled by transferring the electric stress around a component in the X-ray generator to a location remote from the component. In particular, the thermal and electrical stresses are decoupled by transferring the electrical stress to an insulation member having a conductive element and connected to a component around which such stresses are present in the X-ray generator. The conductive element is configured to provide an electric potential substantially equal to the electric potential of the component. However, in other embodiments, the electrical potential of the conductive element is within a range of the electric potential of the component, for example, within a difference of between about ten percent and about sixty percent.

Figure 1:
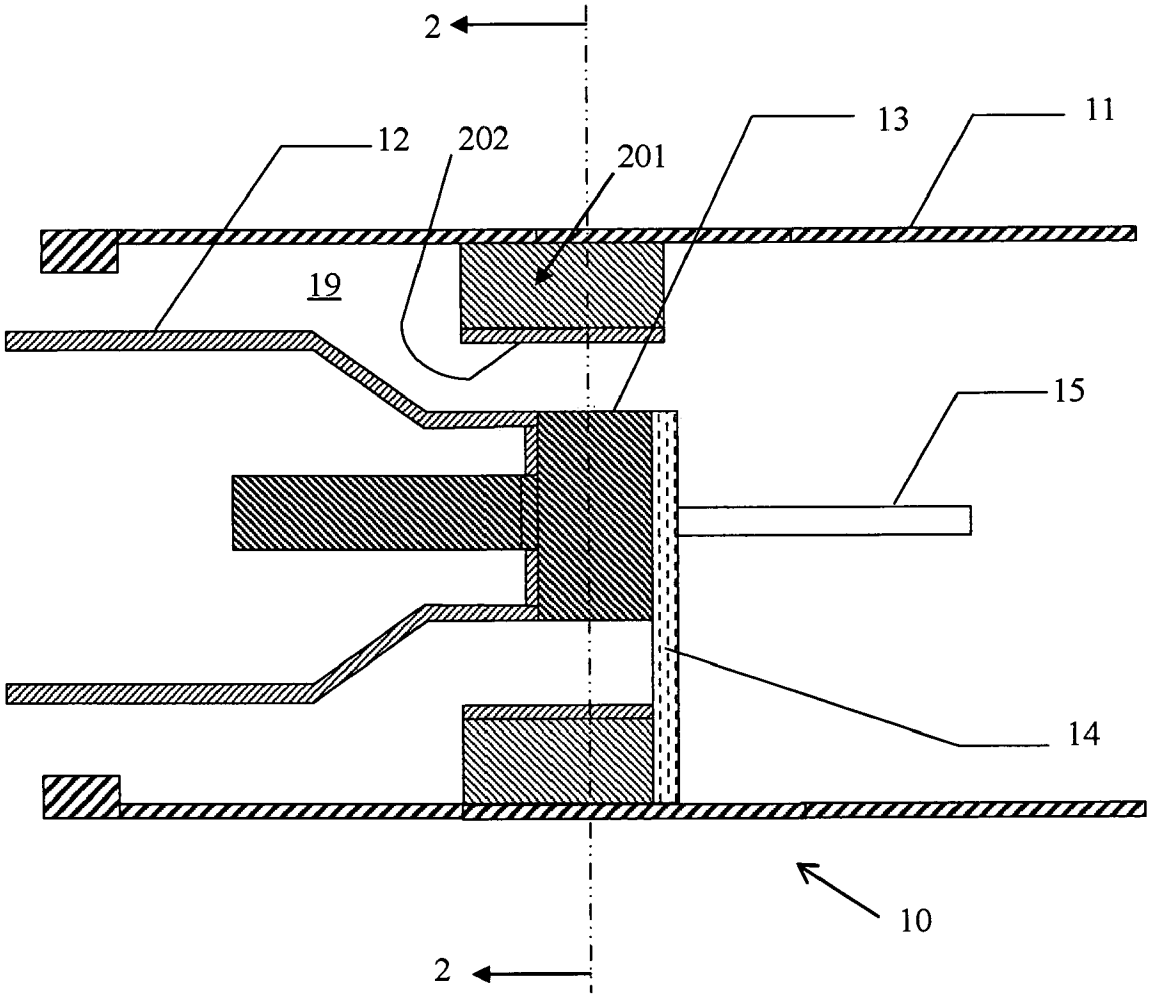
FIG. 1 is a partial cross-sectional view of an X-ray generator according to one embodiment of the present invention.
Figure 2:
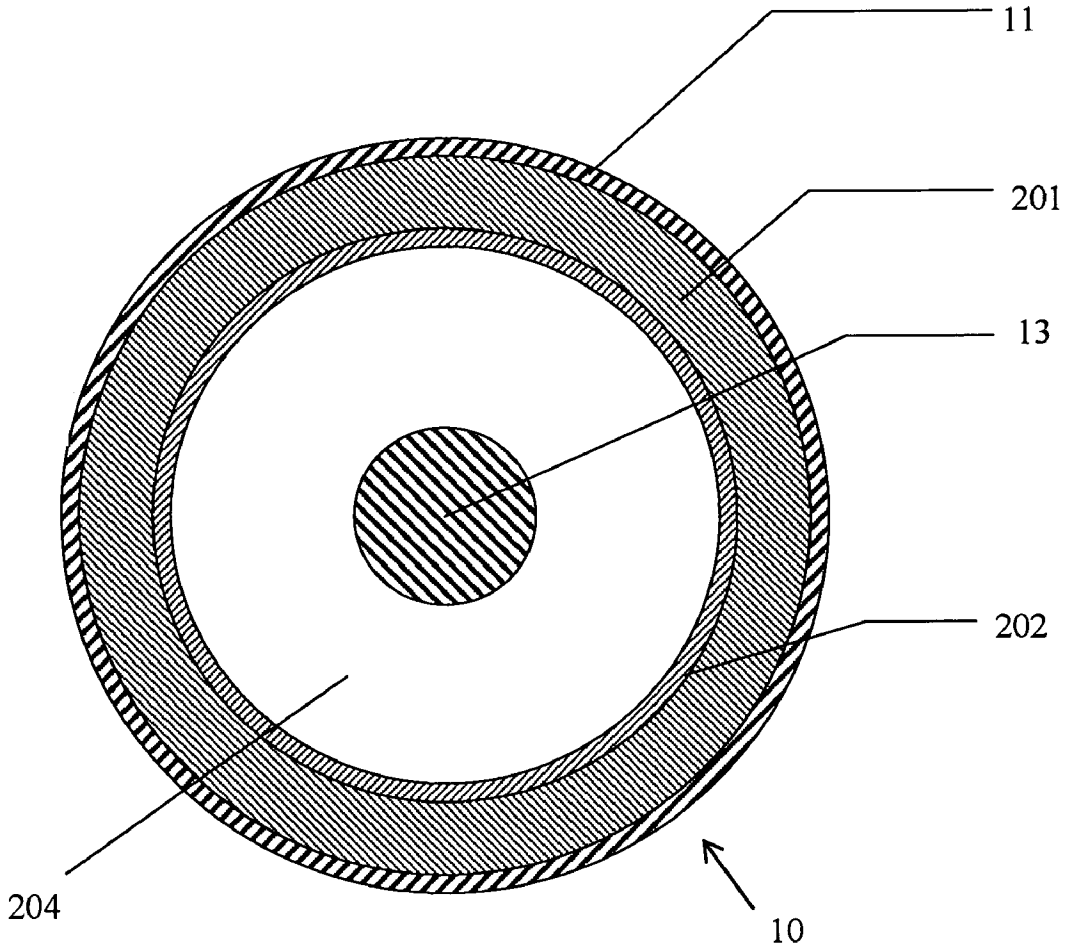
FIG. 2 is a cross-sectional view of the X-ray generator of FIG. 1 taken along the line 2-2.

FIGS. 1 and 2 are exemplary diagrams of an X-ray generator according to one embodiment of the present invention. The X-ray generator 10 includes a housing 11 having a generally cylindrical cross-section as shown more clearly in FIG. 2 and is constructed of, for example, metal, which is maintained at ground potential. A vacuum tube 12 for X-ray generation includes an anode 13 and is connected to a high voltage DC power supply (not shown) with connection member 15 (e.g., high voltage cable). The vacuum tube 12 is supported inside the housing 11 by a rigid insulating support member 14. A thermal transfer fluid 19, such as, for example, an insulating oil is disposed within the housing 11 to provide heat dissipation during operation of the X-ray generator 10.

FIG. 2 is a cross-sectional view of the X-ray generator 10 of FIG. 1. An insulation member 201 having a conductive element 202 (e.g., metallic layer) is provided around the anode 13. In one embodiment, the insulation member 201 is provided on the inner surface of the housing 11 and the conductive element 202 is exposed to the anode surface and configured to provide or form a gap 204 therebetween. The insulation member 201 is formed of an insulating material, such as, for example, an epoxy, polypropylene, pressboard, etc., and may be integrally formed on the inner surface of the housing 11 or configured for attachment to the housing 11 by suitable means.

Figure 3:
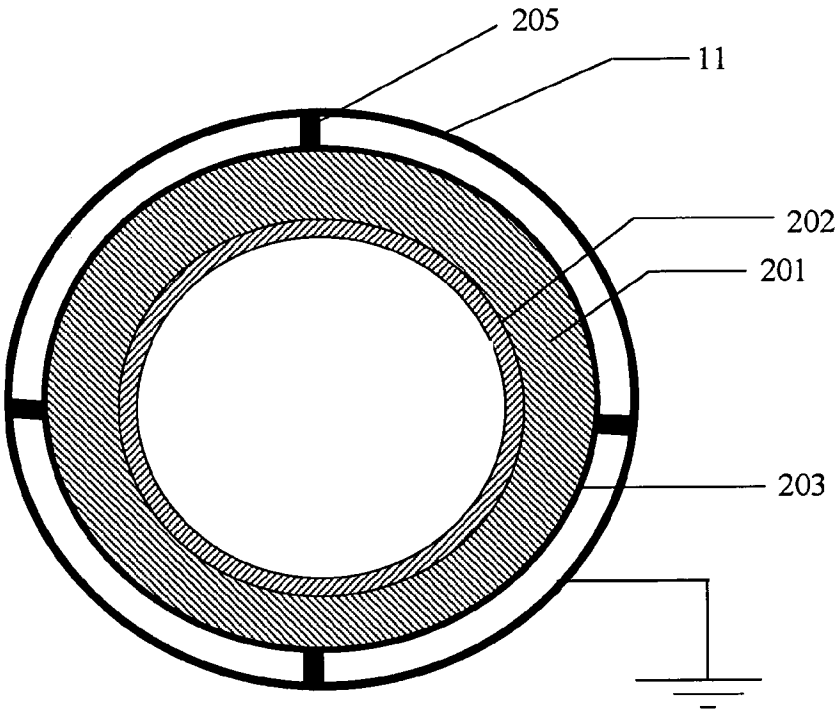
FIG. 3 is a front cross-sectional view of a cylindrical X-ray generator housing having an insulation member therein according to one embodiment of the present invention.
Figure 4:
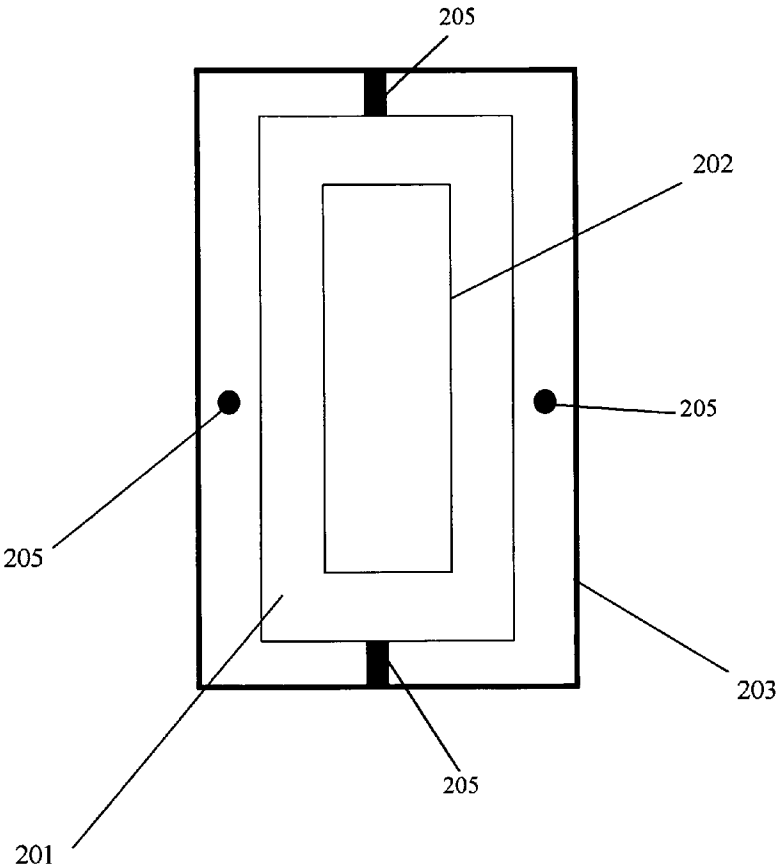
FIG. 4 is a front cross-sectional view of a rectangular X-ray generator housing having an insulation member therein according to an embodiment of the present invention.
Figure 5:
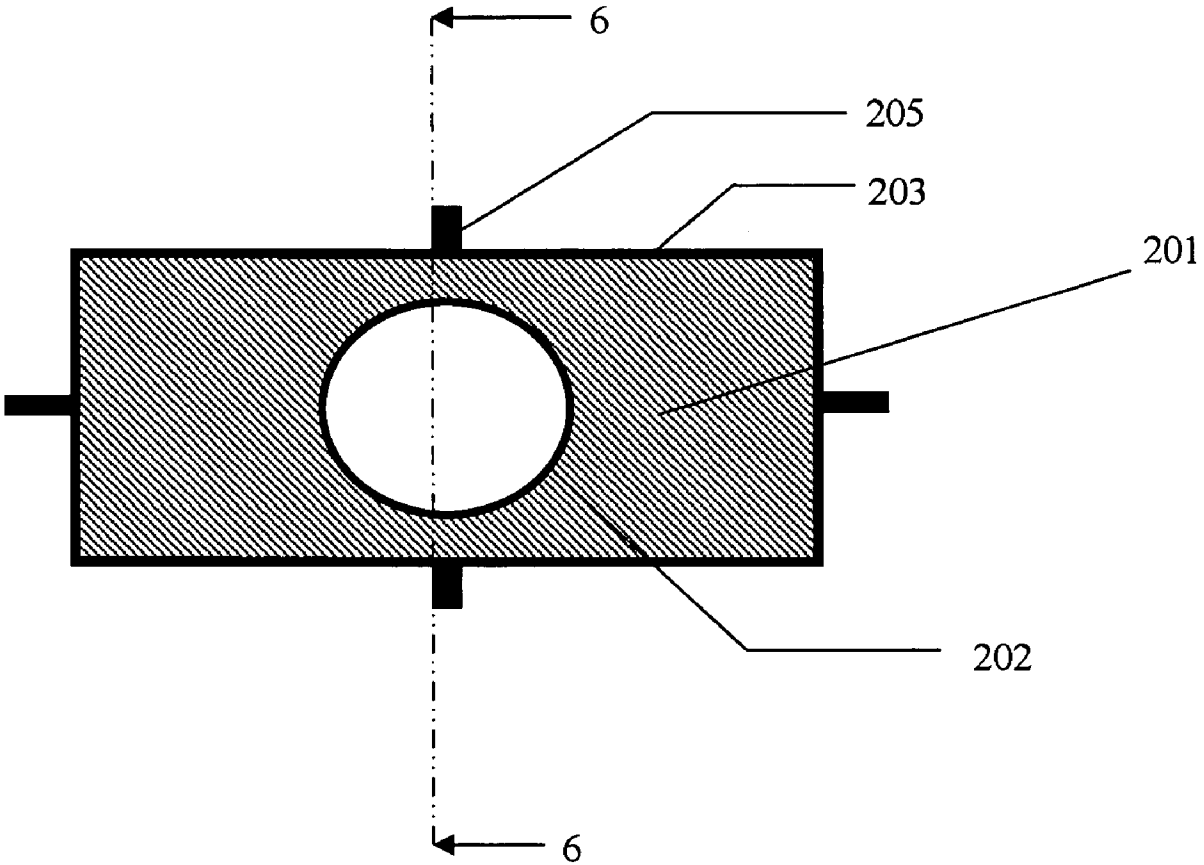
FIG. 5 is a front cross-sectional view of a rectangular X-ray generator housing having an insulation member therein according to another embodiment of the present invention.
Figure 6:
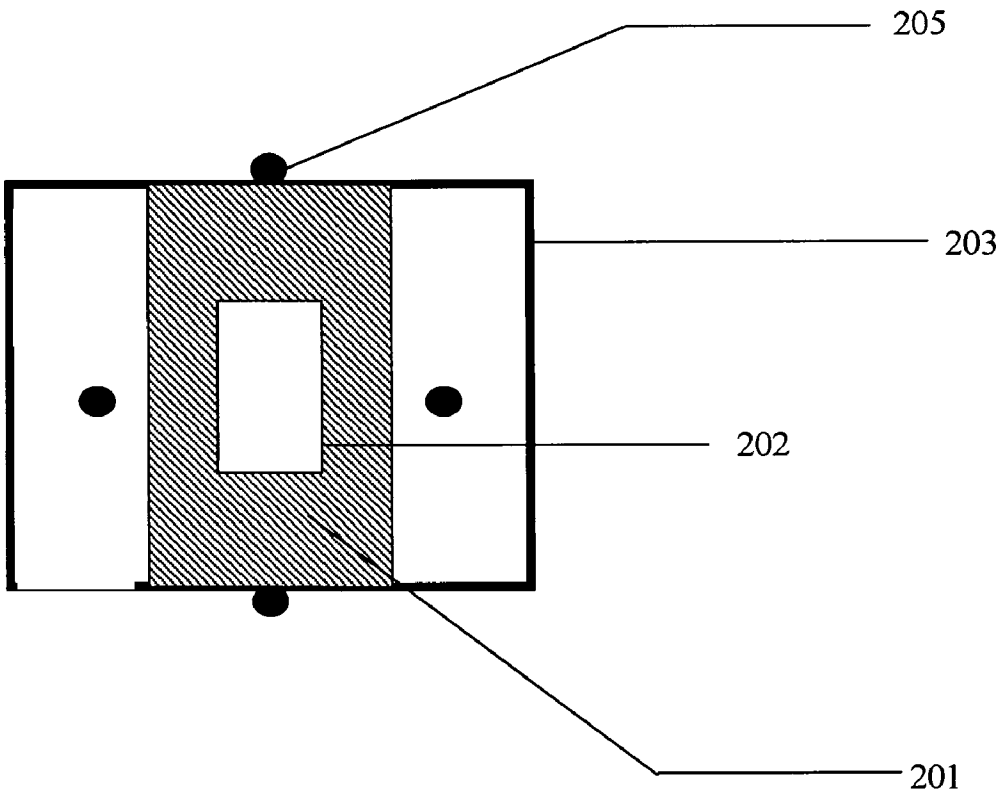
FIG. 6 is a cross-sectional view of the rectangular X-ray generator housing of FIG. 5 taken along the line 6-6.

For example, as shown in FIG. 3, the insulation member 201 may be provided between two conductive elements 202, 203 with conductive element 202 at an inner side, and conductive element 203 at an outer side, and together having a shape configured for positioning and attachment to the housing 11. In one embodiment, the size (e.g., diameter) of the outer conductive element 203 is smaller than the size of the housing 11 such that the insulation member 201 that is constructed separately may be assembled or connected to the housing 11. In other embodiments as shown in FIGS. 4 through 6, the housing 11 may have different shaped cross-sections, such as, for example, a rectangular cross-section.

In the various embodiments as shown in FIGS. 3 through 6, the outer conductive element 203 may have protruding electrical connections 205 for connection to an inner surface of the housing 11. It should be noted that the outer conductive element 203 may have a width more than the width of the insulation member 201 to allow attachment (e.g., screw connection) of the insulation member 201 to the housing 11.

The insulation member 201 may have different shapes, for example, based on the shape of the housing 11. Further, the size and/or dimensions of the insulation member 201 is selected such that, for example, adequate creepage distance is maintained between the inner conductive element 202 and the outer conductive element 203 and the housing 11. Further, the conductive element 202 may be formed as an integral part of the insulation member 201 or may be formed as a coating layer.

Figure 7:
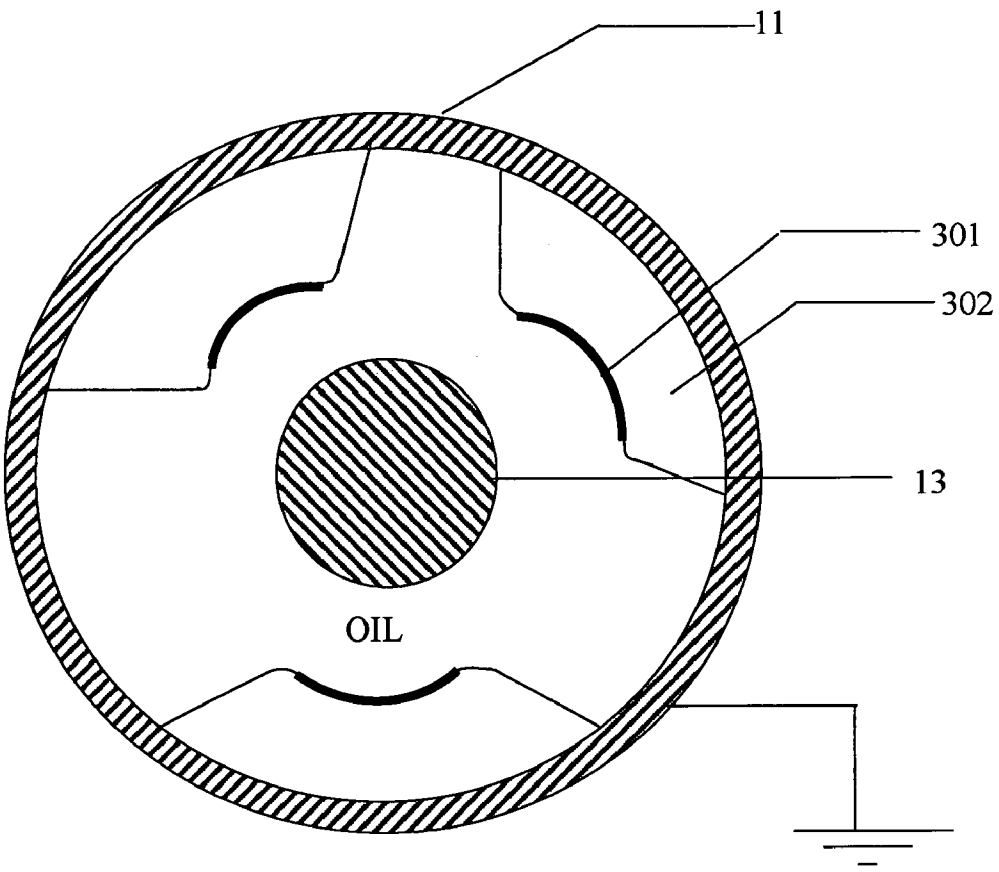
FIG. 7 is a cross-sectional view of an X-ray generator having a conductive element in discrete form according to an embodiment of the present invention.

In another embodiment shown in FIG. 7, an insulation member 302 and a conductive element 301 (e.g., metallic layer) are configured in a discrete arrangement around the anode 13 (e.g., a plurality of conductive elements 301). In this embodiment, the conductive element 301 is formed as an integral part of the insulation member 302. In other embodiments, the conductive element 301 may be formed as a coating on the surface of the insulation member 302. The discrete arrangement allows for implementation, for example, in X-ray generators wherein securing a continuous cylindrical conductive element to the housing 11 is not possible or difficult.

Figure 8:
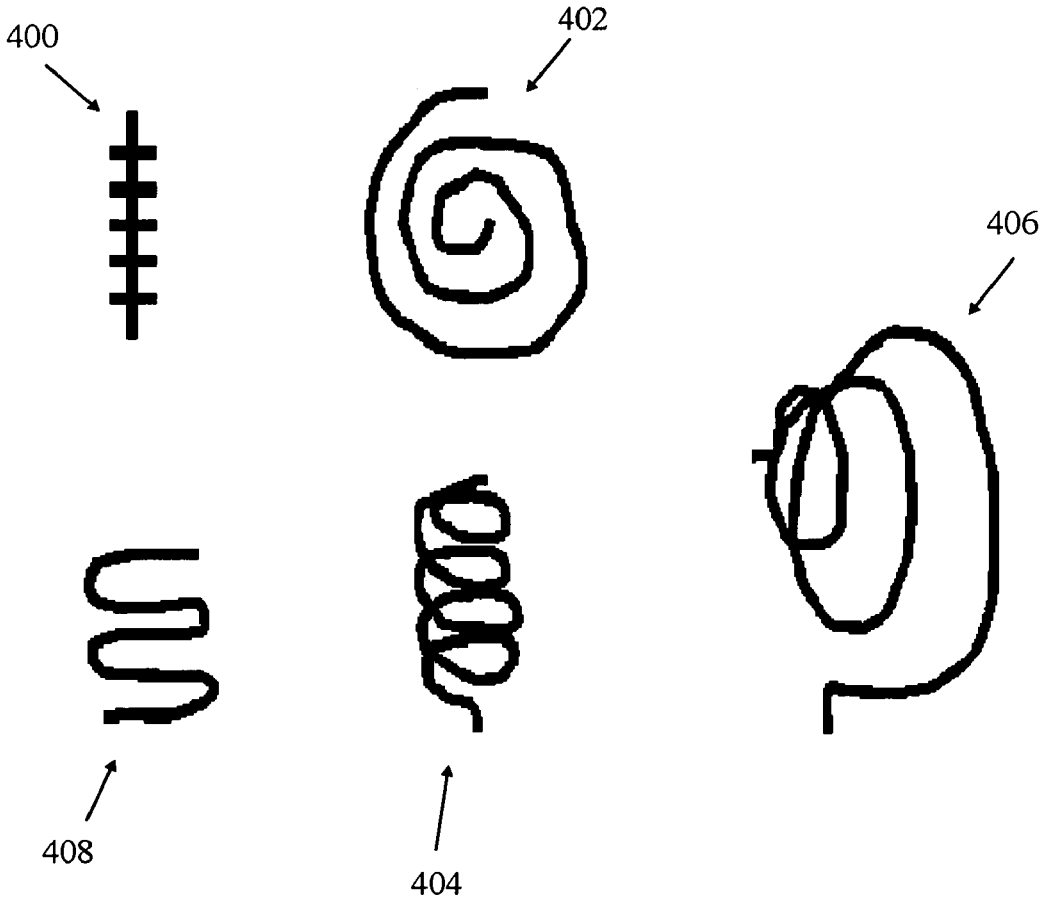
FIG. 8 is a diagram of electrical conductors according to various embodiments of the present invention.

Referring again to FIGS. 1 and 2, the conductive element 202 is electrically connected to the anode 13 by any suitable means or methods. For example, in one embodiment, the conductive element 202 is connected in parallel to the anode 13 by a separate wire/cable adjacent an anode connection (not shown). In another embodiment, a rigid electrical conductor (not shown) having high thermal dissipation properties is used to directly connect the anode 13 and the conductive element 202. For example, a rigid electrical conductor provided as a straight pillar connecting the anode 13 and the conductive element 202 may be used. The electrical conductor may have substantial heat dissipating properties. In general, the electrical conductor may be, for example, one of a connector with fins 400, a spirally coiled wire 402, a helical spring 404, an elongated spirally coiled wire 406, a zig-zag bent wire 408, etc. as shown in FIG. 8.

The connection of the conducting element 202 to the anode 13 provides an electric potential substantially equal to the electric potential of the anode. An equipotential region is formed in the gap 204 (shown in FIG. 2) between the anode 13 and the conductive element 202, thereby resulting in a near zero electric field in the gap 204. The electric stress near the anode 13 is, thus, transferred onto the insulating member 201 and the thermal stress remains near the anode 13, thereby decoupling the electrical and thermal stresses around anode 13. Decoupling electrical and thermal stresses reduces the multi-factor aging effects resulting from combined electrical and thermal stresses in insulation around the anode region and improves reliability.

In other embodiments, the electrical potential of the conductive element 202 is within a range of the electric potential of the component. For example, the electric potential of the conductive element 202 may be plus or minus within about ten percent to about sixty percent of the electric potential of the component. For example, an electric potential difference of about twenty percent may be provided. However, the difference in potential of the various embodiments are not limited to a particular range or value and may be between zero and one hundred percent or more.

It should be noted that the insulation member 201 occupies a substantially small volume of the housing 11 and, therefore, the reduction in the heat dissipation ability of the system due to the addition of the insulation member 201 remains substantially low.

In other embodiments, the anode 13 may have thermal conductors (e.g., fins) to increase the surface area and allow increased heat dissipation in combination with the insulating oil. It should be noted that implementation of thermal conductors for increasing the heat dissipation surface area of the anode 13 may be provided without considering the affect on electrical fields because the insulating oil experiences very little, if any, electric field due to the presence of equipotential zone in the gap 204 (shown in FIG. 2) between the anode 13 and the conductive element 202.

Further, it should be noted that the conductive element 202 as described herein may have a flat surface or a non-flat surface (e.g., corrugated surface). Further, the surface of the conductive element 202 may have various shapes and configurations, which may be modified, for example, based upon heat dissipation requirements or needs.

While the invention has been described in terms of various specific embodiments, those skilled in the art will recognize that the invention can be practiced with modification within the spirit and scope of the claims.

What is claimed is:

1. An insulation method for an X-ray generator, said method comprising:

providing a conducting surface inside a housing of an X-ray generator concentric with and coupled to an anode within the X-ray generator and at a distance from the anode;

configuring the conducting surface to have an electric potential substantially equal to an electric potential of the anode to transfer an electric field to a location remote from the anode; and transferring the electric field to a solid insulation that is axially aligned with the configured conducting surface, the solid insulation radially outward from and directly adjacent to the configured conducting surface.

2. A method according to claim 1 further comprising transferring the electric field to a location remote from an area having a thermal stress.

3. A method according to claim 1 further comprising providing a plurality of conducting surfaces concentric with and electrically coupled to the anode.

4. A method according to claim 1 further comprising creating an equipotential region around the anode and an X-ray tube with the configured conducting surface.

5. A method according to claim 1 further comprising transferring the electric field to one of a liquid and gaseous insulation having the configured conducting surface.

6. A method according to claim 1 wherein the solid insulation comprises an epoxy.

7. A method according to claim 1 wherein the solid insulation comprises polypropylene.

8. A method according to claim 1 further comprising forming the conducting surface as an integral part of the solid insulation.

9. A method according to claim 1 further comprising coating the solid insulation with the conducting surface.

10. An insulation configuration for an X-ray system, said insulation configuration comprising:

at least one insulation member having at least one conductive element layer and at Icast one insulation material layer that are axially aligned, said at least one insulation member positioned inside an X-ray housing concentric with and electrically coupled to an anode within an X-ray system, said at least one insulation member positioned at a distance from the anode; and said at least one conductive element layer radially inward from and positioned directly against said at least one insulation material layer, said at least one conductive element layer configured to provide a surface at an electric potential substantially equal to an electric potential of the anode.

11. An insulation configuration according to claim 10 wherein the X-ray system comprises an X-ray generator and wherein a distance defines a gap between the anode and a casing of the X-ray generator having an equipotential region therein.

12. An insulation configuration according to claim 10 wherein the at least one insulation material layer comprises a solid insulation component.

13. An insulation configuration according to claim 10 wherein the conductive element layer is formed as part of the at least one insulation member.

14. An insulation configuration according to claim 10 wherein the conductive element layer is coated on the at least one insulation member.

15. An insulation configuration according to claim 10 wherein said at least one insulation member comprises a first conductive element layer, a second conductive element layer, and at least one insulation material layer, said at least one insulation material layer coupled between said first conductive element layer and said second conductive element layer, said first conductive element layer radially outward from and adiacent to the anode, said second conductive element layer radially inward from and directly the X-ray housing.

16. An X-ray generator comprising:

a housing;

an anode coupled within said housing;

an insulation member having an insulation material layer and a conductive element layer that are axially aligned, said insulation member coupled to an inside surface of said housing, said insulation material layer radially outward from and coupled directly adjacent said conductive element layer, said insulation member concentric with and separated from said anode by a gap, said conductive element layer configured to provide an electric potential substantially equal to an electric potential of said anode to create an equipotential region in the gap; and a thermal transfer fluid within the gap.

17. An X-ray generator according to claim 16 wherein the insulation member is configured having a width more than a width of the conductive element layer.

18. An X-ray generator according to claim 16 wherein the insulation member is configured having a size less than a size of the housing.

19. An X-ray generator according to claim 16 wherein the insulation member is mounted to the housing by screw fixing.

20. An X-ray generator according to claim 16 wherein the insulation member is configured to have electrical connections for connecting to the housing.

21. An X-ray generator according to claim 16 wherein a predetermined creepage distance is maintained between the conductive element layer and the housing.

* * * * *